United States Patent [19]

Lo

[11] Patent Number: 4,824,102

[45] Date of Patent: Apr. 25, 1989

[54] EXERCISE BICYCLE FOR EXERCISING ARMS AND LEGS

[76] Inventor: Peter K. Lo, P.O. Box 13-124, Taipei, Taiwan

[21] Appl. No.: 192,166

[22] Filed: May 10, 1988

[51] Int. Cl.[4] ..... A63B 21/00

[52] U.S. Cl. ..... 272/73; 74/48

[58] Field of Search ..... 272/73, 71, 72, 116, 272/120; 74/665 GE, 48, 47; 128/25 R

[56] References Cited

U.S. PATENT DOCUMENTS

| | | | |
|---|---|---|---|
| 4,657,244 | 4/1987 | Ross | 272/73 |
| 4,712,789 | 12/1987 | Brilando | 272/73 |
| 4,757,988 | 7/1988 | Szymski | 272/73 |

*Primary Examiner*—Richard J. Apley
*Assistant Examiner*—S. R. Crow

[57] ABSTRACT

An exercise bicycle has a suspended wheel which is sleeved rotatably on a wheel axle. The wheel axle has a first key-way formed in one end portion thereof, and two opposed second key-ways formed in two opposite sides of the other end portion of the wheel axle. One of the second key-ways and the first key-way are aligned with each other and formed in the same side of the wheel axle. Two swing arms are secured to respective end portions of the wheel axle. One of the swing arms has a first key engaged with the first key-way and the other swing arm has a second key which is selectively engaged with one of the second key-ways so that the first and second keys may be connected to the same side or opposite sides of the wheel axle. Two swing levers are mounted pivotally at their lower ends on a base frame and connected at their upper portions to the respective swing arms. When the swing levers are swung by hand in either the same direction or opposite directions, the wheel can be rotated through a transmission line.

5 Claims, 5 Drawing Sheets

EXERCISE BICYCLE FOR EXERCISING ARMS AND LEGS

BACKGROUND OF THE INVENTION

This invention relates to an exercise bicycle, and more particularly to one which has a suspended wheel, the suspended wheel being indirectly rotatable by hands, and/or feet.

A kind of exercise bicycle has been developed to simultaneously exercise the arms and legs of a user. A pair of swing levers are incorporated in such an exercise bicycle. The swing levers can be swung in opposite directions to rotate a wheel axle and hence a wheel which is sleeved rigidly on the wheel axle. The wheel is supsended on the bicycle. Certainly, this kind of exercise bicycle may be designed such that the swing levers can be swung in the same direction to rotate the suspended wheel in accordance with the selection of the manufacturer. However, the swing levers cannot be freely adjusted to swing in either the same direction or opposite directions.

SUMMARY OF THE INVENTION

It is therefore the main object of this invention to provide an exercise bicycle with two hand operated swing levers, both of which can be adjusted to swing in either the same direction or opposite directions for rotating a suspended wheel.

According to this invention, an exercise bicycle has a frame assembly including a base frame, a driven wheel frame fixed on the front portion of the base frame, and a seat frame fixed on the rear portion of the base frame. A foot operated drive assembly includes a driving shaft journalled on the seat frame, a rear driving sprocket sleeved rigidly on the intermediate portion of the driving shaft, two crank arms respectively secured to two ends of the driving shaft, and two pedals secured to the respective crank arms. A hand operated drive assembly includes a wheel axle journalled on the wheel frame, a front driving sprocket sleeved rigidly on the wheel axle, two swing arms secured to two opposite end portions of the wheel axle, and two hand operated swing levers mounted pivotally at their lower ends on the base frame. Each of the levers has a guide-way along the length thereof. Each of the swing arms has a crank pin member connected slidably to the corresponding lever so that the crank pin member can slide along the guide-way of the correspnding lever. A driven sprocket assembly includes a driven shaft journalled on the base frame between the driving shaft and the wheel axle, a foot driven sprocket sleeved rotatably on the driven shaft, clutch means for locking the foot driven sprocket on the driven shaft when the foot driven sprocket rotates in a predetermined direction, a foot driven chain trained on the rear driving sprocket wheel and the foot driven sprocket, a hand driven sprocket sleeved rotatably on the driven shaft, clutch means for locking the hand driven sprocket on the driven shaft when the hand driven sprocket rotates in a predetermined direction, a hand driven chain trained on the front driving sprocket and the hand driven sprocket, and a wheel driving sprocket sleeved rigidly on the driven shaft. A wheel assembly includes a wheel hub sleeved rotatably on the wheel axle, a wheel sleeved rigidly on the wheel hub, a hub sprocket sleeved rigidly on the wheel hub, and a wheel driving chain trained on the wheel driving sprocket and the hub sprocket.

The wheel axle has a first key-way formed in one end portion thereof, and a pair of opposed second key-way formed in two opposite sides of the other end portion of the wheel axle. One of the second key-ways and the first key-way are aligned with each other and formed in the same side of the wheel axle. One of the swing arms has a first key engaged with the first key-way, while the other of the swing arms has a second key which is selectively engaged with one of the second key-ways. Thereby, the first and second keys may be connected to the same side or opposite sides of the wheel axle.

When the pedals are rotated in a predetermined direction, the driving shaft, rear driving sprocket, foot driven chain, foot driven sprocket, driven shaft, wheel driving sprocket, wheel driving chain, hub sprocket, hub, and wheel are all in turn rotated in the predetermined direction.

When the levers are swung, the wheel axle, front driving sprocket, hand driven chain, hand driven sprocket, driven shaft, wheel driving sprocket, wheel driving chain, hub sprocket, hub, and wheel are in turn rotated in the predetermined direction.

When a first torque is applied to the driven shaft through the foot driven sprocket by rotating the pedals in the predetermined direction, and when a second torque is applied to the driven shaft through the hand driven sprocket by swinging the levers, the sum of the first and second torques is output through the wheel driving sprocket.

BRIEF DESCRIPTION OF THE DRAWINGS

Other features and advantages of this invention will become apparent in the following detailed description of a preferred embodiment of this invention with reference to the accompanying drawings in which.

DETAILED DESCRIPTION OF THE PREFERRED EMBODIMENT

Figure 1:
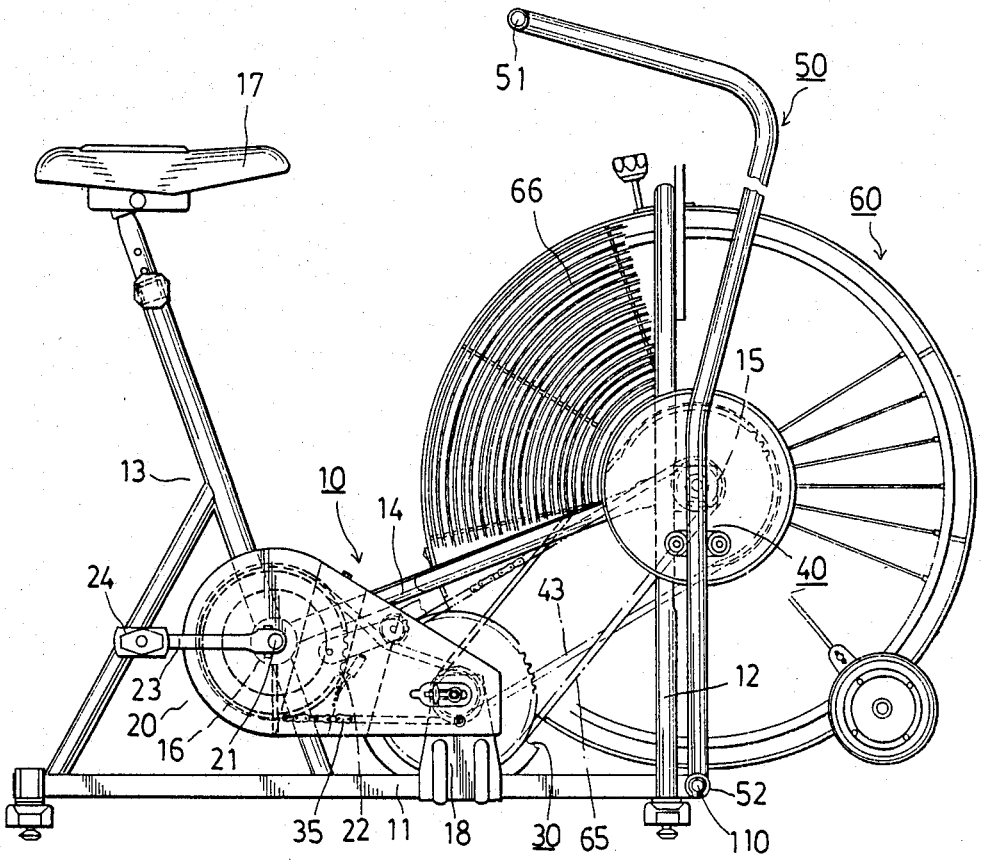
FIG. 1 is a schematic side view of an exercise bicycle according to this invention.

Referring to FIG. 1, an exercise bicycle of this invention includes a frame assembly 10, a foot drive assembly 20, a driven sprocket assembly 30, a wheel axle assembly 40, a swing lever assembly 50, and a driven wheel assembly 60.

The frame assembly 10 has a base frame 11 on which a driven wheel frame 12 and a seat frame 13 are fixed. The wheel frame 12 and the seat frame 13 are coupled by a strut 14. A front bearing block 15 is provided at the juncture between the wheel frame 12 and the strut 14. A rear bearing block 16 is provided at the juncture between the seat frame 13 and the strut 14. A saddle 17 is supported on the seat frame 13. A pair of opposed bearing plates 18 are fixed on the base frame 11 between the wheel frame 12 and the seat frame 13.

The foot drive assembly 20 includes a driving shaft 21 journalled on the bearings of the rear bearing block 16. The driving shaft 21 includes a rear driving sprocket 22 sleeved rigidly thereon, and two crank arms 23 secured to respective ends of said driving shaft 21. Each of the crank arms 23 carries a pedal 24 on the end thereof.

Figure 2:
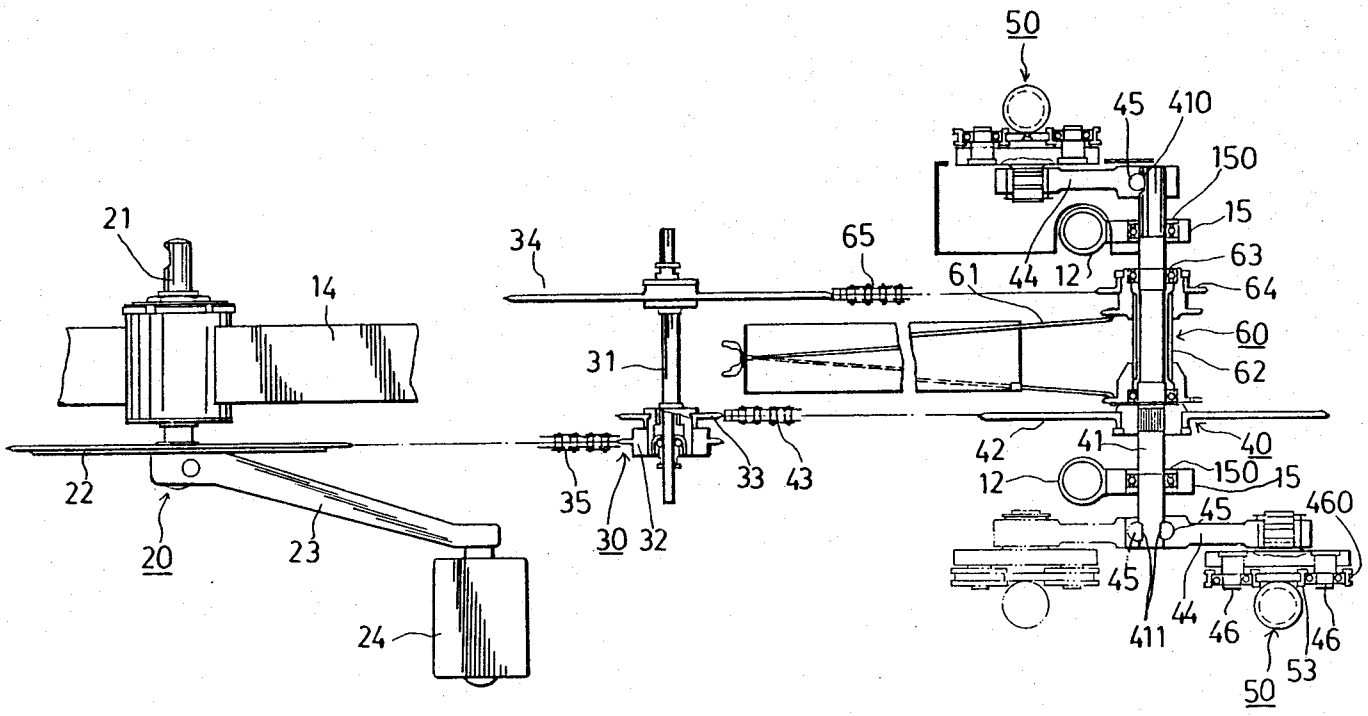
FIG. 2 is a schematic top view of the exercise bicycle according to this invention.

As shown more clearly in FIG. 2, the driven sprocket assembly 30 includes a driven shaft 31 which is journalled on the bearing plates 18. The driven shaft 31 includes a foot driven sprocket 32 sleeved rotatably on the right portion thereof, a hand driven sprocket 33 sleeved rotatably on the middle portion of the driven shaft 31, and a wheel driving sprocket 34 sleeved rigidly on the driven shaft 31. A foot driven chain 35 is trained on the rear driving sprocket 22 and the foot driven sprocket 32.

Figure 5:
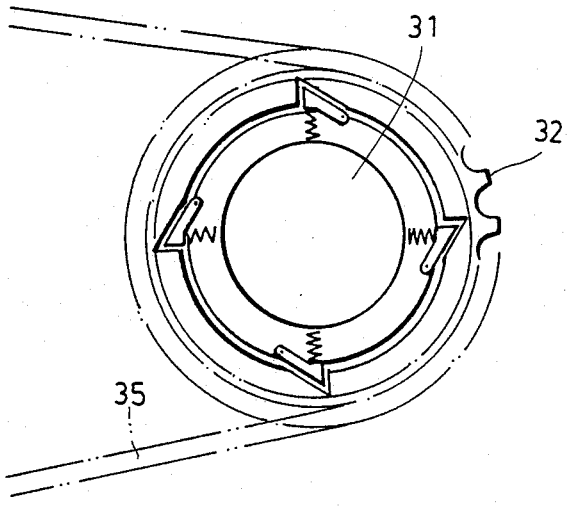
FIG. 5 is a schematic side view illustrating the connection between the driven shaft and the foot driven sprocket of the exercise bicycle in accordance with this invention.

Referring to FIG. 5, a first spring-biased ratchet mechanism is provided between the foot driven sprocket 32 and the driven shaft 31 in a known manner so that, when the foot driven sprocket 32 is rotated clockwise by stepping on the pedals 24, it is locked on the driven shaft 31 by the ratchet mechanism and thus also rotates clockwise. When the foot driven sprocket 32 is rotated counterclockwise, the ratchet mechanism is released to unlock the driven shaft 31 from the foot driven sprocket 32. With the first ratchet mechanism provided between the foot driven sprocket 32 and the driven shaft 31, the foot driven sprocket 32 can be driven by the driven shaft 31 only when the driven shaft 31 rotates counterclockwise. However, the driven shaft 31 cannot drive the foot driven sprocket 32 due to the fact that the driven shaft 31 never rotates counterclockwise, as described hereinafter.

Figure 6:
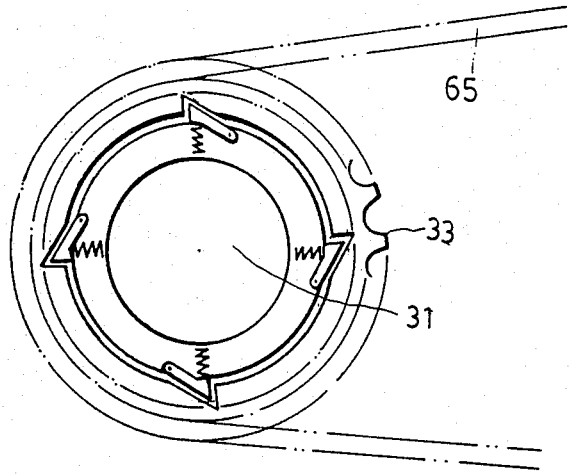
FIG. 6 is a schematic side view illustrating the connection between the driven shaft and the hand driven sprocket of the exercise bicycle in accordance with this invention.

Referring to FIG. 6, a second ratchet mechanism is provided between the hand driven sprocket 33 and the driven shaft 31 to perform the same function as the first ratchet mechanism. Therefore, both the foot driven sprocket 32 and the hand driven sprocket 33 act as the power input sprockets of the driven shaft 31. Because the wheel driving sprocket 34 is sleeved rigidly on the driven shaft 31, it can be driven by the same and can thus act as a power output sprocket. As a result, because the driven shaft 31 can rotate only when either the foot driven sprocket 32 or the hand driven sprocket 33 is rotated clockwise, the driven shaft 31 can only rotate clockwise and cannot drive the foot driven sprocket 32 and/or the hand driven sprocket 33 forever. As another result of providing these ratchet mechanisms, when a first torque is applied to the driven shaft 31 through the foot driven sprocket 32 and a second torque is applied to the driven shaft 31 through the hand driven sprocket 33, the sum of the first and second torques is output from the driven shaft 31 through the wheel driving sprocket 34.

Figure 4:
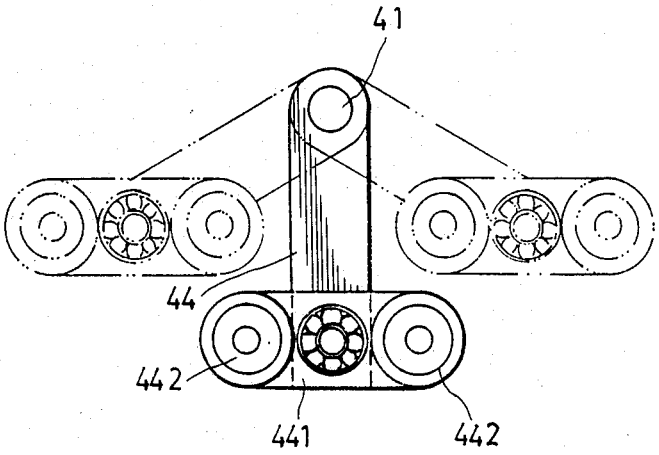
FIG. 4 is a schematic side view illustrating the swinging movement of the swing arm of the exercise bicycle according to this invention.

The wheel axle assembly 40 includes a wheel axle 41 journalled on axle bearings 150 which are mounted within the front bearing block 15. A front driving sprocket 42 is sleeved rigidly on the wheel axle 41. A hand driven chain 43 is trained on the front driving sprocket 42 and the hand driven sprocket 33. Two swing arms 44 are sleeved on respective ends of the wheel axle 41. The wheel axle 41 has a left key-way 410 formed in its left end portion, and two opposed second key-ways 411 formed in the opposite sides of the right end portion of the wheel axle 41. The left swing arm 44 has a key 45 projecting therefrom to enage with the left key-way 410. The right swing arm 44 may be rotated relative to the wheel axle 41 to engage either of the right key-ways 411 with the key 45. Accordingly, the swing arms 44 may be freely adjusted to locate on opposite sides or the same side of the wheel axle 41. When the swing arms 44 are on opposite sides of the wheel axle 41, they can be swung by hand in opposite directions. When the swing arms 44 are on the same side of the wheel axle 41, they can be swung by hand in the same direction. The two manners in which the swing arms 44 are actuated can be selected according to the taste of the user. Because the swing arms 44 may be actuated in two manners, the exercise effect of the bicycle is increased. As shown more clearly in FIG. 4, each of the swing arms 44 includes a crank pin member 441 connected rotatably thereto and can rotate an angle smaller than 180 degrees. Two opposed rollers 442 are mounted rotatably on the crank pin member 441 and have an annular groove 460 therein. A slide slot is thus formed between the two adjacent rollers 442.

Figure 3:
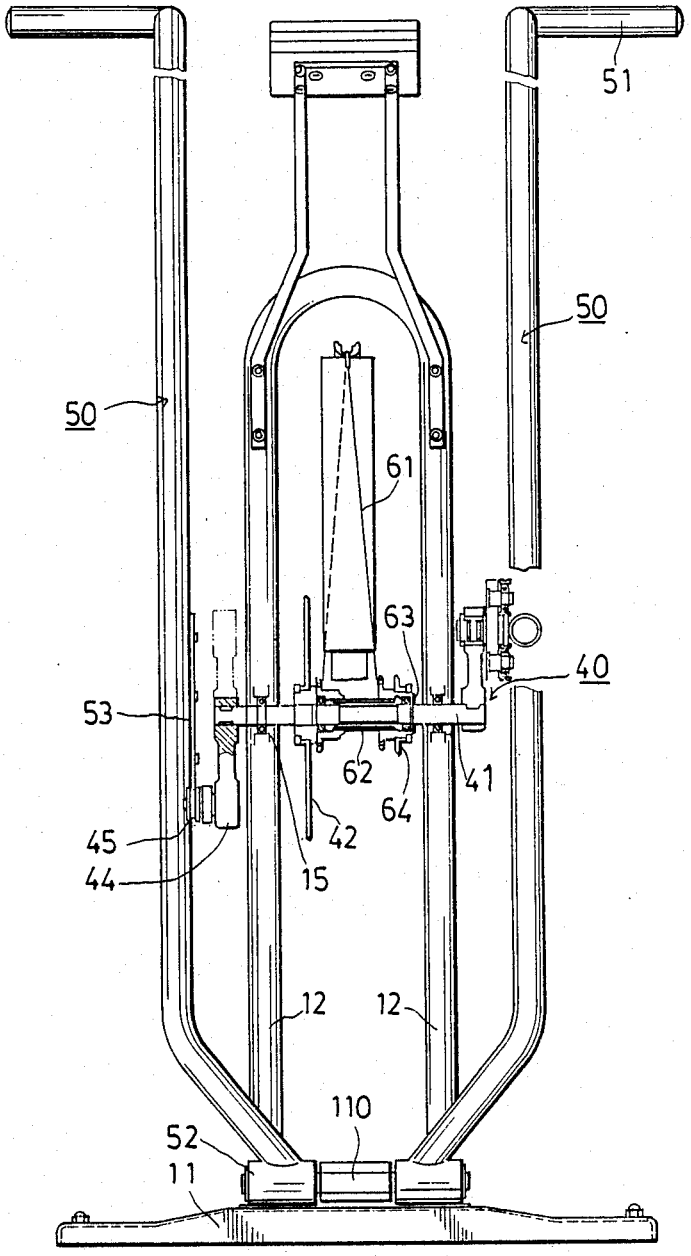
FIG. 3 is a schematic front view of the exercise bicycle according to this invention.

The swing lever assembly 50 includes two swing levers 51, each of which has a lower end sleeve 52 (see FIG. 3) for being sleeved rotatably on a pivot pin 110 fixed on the base frame 11. Each of the levers 51 also includes an elongated rectangular plate 53 secured to its inward surface. The plate 53 is received slidably in the slide slot between the rollers 442 of the corresponding crank pin member 441 so that the crank pin member 441 can slide along the length of the lever 51 when the lever 51 is swung.

The wheel assembly 60 includes a driven wheel 61 which has a wheel hub 62. The wheel hub 62 is sleeved rotatably on the wheel axle 41 by hub bearings 63 and includes a hub sprocket 64 sleeved rigidly on the hub 62. A wheel driving chain 65 is trained on the wheel driving sprocket 34 and the hub sprocket 64. The wheel 61 is enclosed by a net shield 66.

When the pedals 24 are propelled forward, the power is transferred to the wheel 61 through the transmission line of the crank arms 23, the driving shaft 21, the rear driving sprocket 22, the foot driven chain 35, the foot driven sprocket 32, the driven shaft 31, the wheel driving sprocket 34, the wheel driving chain 65, the hub sprocket 64, and the hub 62.

When the levers 51 are swung manually to and fro, the power is transferred to the wheel 61 through the transmission line of the swing arms 44, wheel axle 41, front driving sprocket 42, hand driven chain 43, hand driven sprocket 33, driven shaft 31, wheel driving sprocket 34, wheel driving chain 65, hub sprocket 64, and hub 62.

To reduce the noise resulting from the engagement of the sprockets and the chains, the chains may be replaced with time belts (not shown).

With this invention thus explained, it is apparent that numerous modifications and variations can be made without departing from the scope and spirit of this invention. It is therefore intended that this invention be limited only as indicated in the appended claims.

I claim:

1. An exercise bicycle comprising:

a frame assembly including a base frame, a driven wheel frame fixed on a front portion of said base frame, and a seat frame fixed on a rear portion of said base frame;

a foot operated drive assembly including a driving shaft journalled on said seat frame, a rear driving sprocket sleeved rigidly on an intermediate portion of said driving shaft, two crank arms respectively secured to two ends of said driving shaft, and two pedals secured to said respective crank arms;

a hand operated drive assembly including a wheel axle journalled on said wheel frame, a front driving sprocket sleeved rigidly on said wheel axle, two swing arms secured to two opposite end portions of said wheel axle, and two hand operated swing levers mounted pivotally at their lower ends on said base frame, each of said levers having a guide-way along a longitudinal axis thereof, each of said swing arms having a crank pin member which is connected slidably to said corresponding lever, so that said crank pin member can slide along said guide-way of said corresponding lever;

a driven sprocket assembly including a driven shaft journalled on said base frame between said driving shaft and said wheel axle, a foot driven sprocket sleeved rotatably on said driven shaft, clutch means for locking said foot driven sprocket on said driven shaft when said foot driven sprocket rotates in a predetermined direction, a foot driven chain trained on said rear driving sprocket wheel and said foot driven sprocket, a hand driven sprocket sleeved rotatably on said driven shaft, clutch means for locking said hand driven sprocket on said driven shaft when said hand driven sprocket rotates in a predetermined direction, a hand driven chain trined on said front driving sprocket and said hand driven sprocket, and a wheel driving sprocket sleeved rigidly on said driven shaft; and a wheel assembly including a wheel hub sleeved rotatably on said wheel axle, a wheel sleeved rigidly on said wheel hub, a hub sprocket sleeved rigidly on said wheel hub, and a wheel driving chain trained on said wheel driving sprocket and said hub sprocket;

whereby, when said pedals are rotated in said predetermined direction, said driving shaft, rear driving sprocket, foot driven chain, foot driven sprocket, driven shaft, wheel driving sprocket, wheel driving chain, hub sprocket, hub, and wheel are in turn rotated in said pedetermined direction;

when said levers are swung, said wheel axle, front driving sprocket, hand driven chain, hand driven sprocket, driven shaft, wheel driving sprocket, wheel driving chain, hub sprocket, hub, and wheel are in turn rotated in said predetermined direction; and when a first torque is applied to said driven shaft through said foot driven sprocket by rotating said pedals in said predetermined direction, and when a second torque is applied to said driven shaft through said hand driven sprocket by swinging said levers, the sum of said first and second torques are output through said wheel driving sprocket.

2. An exercise bicycle as claimed in claim 1, wherein said wheel axle has a first key-way formed in one end portion thereof, and a pair of opposed second keyways formed in two opposite sides of the other end portion of said wheel axle, one of said second key-ways and said first key-way being aligned with each other and formed in same side of said wheel axle, and wherein one of said swing arms has a first key engaged with said first key-way, while the other of said swing arms has a second key which is selectively engaged with one of said second key-ways, whereby, said first and second keys may be connected to same side or opposite sides of said wheel axle.

3. An exercise bicycle as claimed in claim 1, wherein each of said crank pin members includes a guide mounted rotatably on a free end thereof, said guide including two spaced rollers forming a slide slot therebetween, and wherein said guide-way of each of said levers is a rectangular panel secured thereto and received slidably in said corresponding slide slot.

4. An exercise bicycle as claimed in claim 1, wherein said driven wheel frame includes two axle bearings on which said wheel axle is journalled.

5. An exercise bicycle as claimed in claim 1, wherein said wheel hub includes two hub bearings mounted on two ends thereof and interposed between said wheel hub and said wheel axle, so that said wheel hub can rotate relative to said wheel axle.

* * * * *